US007153155B1

(12) United States Patent
Lee et al.

(10) Patent No.: US 7,153,155 B1
(45) Date of Patent: Dec. 26, 2006

(54) RECEPTACLE CONNECTOR

(75) Inventors: Shih-An Lee, Tu-Cheng (TW); Kuo-Chin Lin, Tu-Cheng (TW); Kai-Hsiang Chang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/441,040

(22) Filed: May 26, 2006

(51) Int. Cl.
*H01R 13/627* (2006.01)
*H01R 24/00* (2006.01)

(52) U.S. Cl. ..... 439/352; 439/676

(58) Field of Classification Search ..... 439/352, 439/350, 357, 358, 607, 676
See application file for complete search history.

(56) References Cited

U.S. PATENT DOCUMENTS 5,435,744 A * 7/1995 Derstine et al. ..... 439/352
5,772,461 A * 6/1998 Yu ..... 439/352
5,951,317 A * 9/1999 Tracy et al. ..... 439/352
6,454,589 B1 * 9/2002 Yeh ..... 439/352
6,821,139 B1 * 11/2004 Wu ..... 439/352

* cited by examiner

*Primary Examiner*—Hien Vu
(74) *Attorney, Agent, or Firm*—Rosenberg, Klein & Lee

(57) ABSTRACT

A receptacle connector includes a body and a cover assembled outside the body. The body defines a receiving space and a pair of beams. The end of each beam stretches backward to form a guiding projection. The bottom of the guiding projection is a cambered surface. The cover is bent downward from the front portion to form a pair of elastic arms. The bottom portion of the elastic arm is bent forward to form a finger portion. While a plug connector is inserted into the receiving space of the receptacle connector, the elastic arms press against the pressing portion of the plug connector. When the plug connector is dragged accidentally, the elastic portion of the plug connector slides downward along the finger portion to the cambered surface of the guiding projections, and then slides out of the receiving space to set the plug and receptacle connector apart.

14 Claims, 10 Drawing Sheets

RECEPTACLE CONNECTOR

BACKGROUND OF THE INVENTION

1. Field of the Invention

The present invention relates to a receptacle connector, and particularly to a receptacle connector with mechanisms for easily pulling the plug connector out of the receptacle connector.

2. The Related Art

A receptacle connector is commonly used in electronic devices such as network equipments and telephones. The receptacle connector usually includes a terminal module to communicate with a plug connector.

A conventional receptacle connector includes a body and a plurality of terminals fixed in the body. The body defines a receiving space to receive the plug connector. In order to prevent the plug connector apart from the receptacle connector, both the plug and receptacle connector have locking mechanisms. Referring to FIG. 10, a plug connector 80 is shown. The front portion of the plug connector 80 protrudes upward to form a basic lump 81. The rear edge of the basic lump 81 stretches backward and forms an elastic portion 82. The rear edge of the elastic portion 82 still stretches backward from the mid thereof and forms a pressing portion 83. The rear edge of the elastic portion 81 separated by the pressing portion 83 further forms a locking surface 84. Accordingly, the traditional receptacle connector defines a pair of locking projections stretching from the top portion of the body into the receiving space to couple with the locking surfaces 84 of the plug connector 80. While the plug connector 80 is inserted into the receiving space of the receptacle connector, the locking projections of the receptacle connector press against the locking surface 84 of the plug connector 80.

However, while the plug connector 80 is being pulled out of the receiving space, the pressing portion 83 of the plug connector 80 must be pressed firstly to make the locking surfaces 82 of the plug connector 80 apart from the locking projections of the receiving connector. That is, while a cable connecting with the plug connector is dragged accidentally, the plug connector 80 and the receptacle connector can't be separated apart which may lead to a damage of the plug or receptacle connector or a sudden movement of the devices using such receptacle connector.

SUMMARY OF THE INVENTION

Accordingly, an object of the present invention is to provide a receptacle connector which includes a body, a cover assembled outside the body and a plurality of terminals received in the body. The body defines a receiving space and a pair of side boards. The front portion of the side boards stretch into the receiving space and form a pair of locking beams. A guiding projection is defined in the bottom portion of the locking beam. The top surface of the guiding projection is horizontal. The bottom surface of the guiding projection is a cambered surface. The cambered surface originates from the rear edge of the guiding projection downwardly to the lower side of the locking beam. The lower side of the locking beam could be the bottom edge or just a bottom surface of the guiding projection. Each guiding projection forms a receiving cavity from the top surface. The receiving cavity stretches backward and communicates with the receiving space of the receptacle connector. The front portion of the cover is bent downward to form a pair of elastic arms. The bottom of the elastic arm is bent forward to form a finger portion. The finger portion locates behind the receiving cavity of the guiding projection. While a plug connector is inserted into the receiving space of the receptacle connector, the elastic arms of the cover press against the pressing portion of the plug connector. When the cable connecting with the plug connector is dragged accidentally, the elastic portion of the plug connector slides downward along the finger portion of the cover to the cambered surface of the guiding projections. Guided by the cambered surface, the elastic portion of the plug connector slides out of the receiving space to achieve a quick disengagement between the plug connector and the receptacle connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
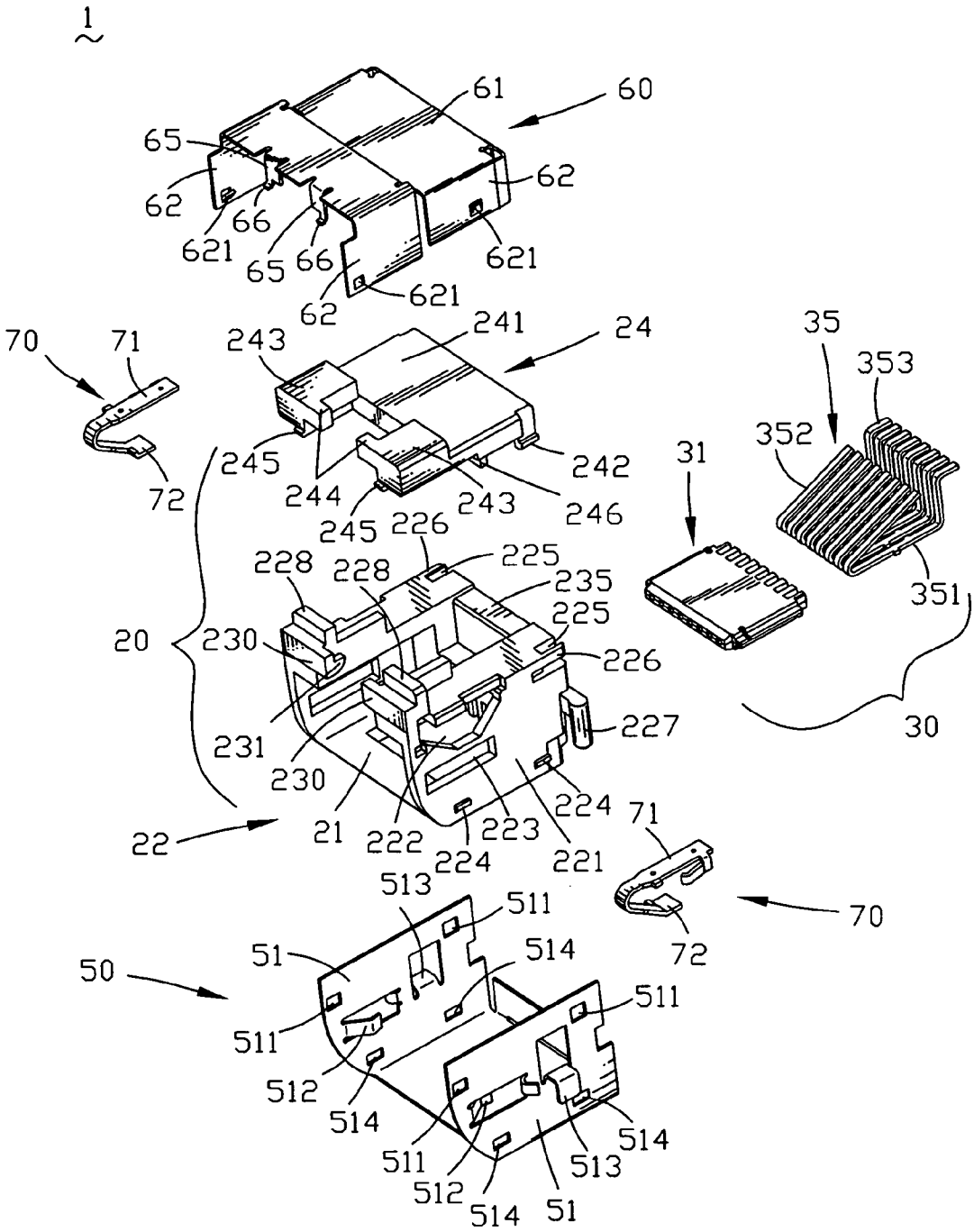
FIG. 1 is a perspective exploded view of a receptacle connector according to the present invention.

Referring to FIG. 1, showing an embodiment of a receptacle connector 1 in accordance with the present invention, the receptacle connector 1 includes a body 20 defining a receiving space 21, a plurality of terminals 30 received in the body 20, a cover further including a bottom cover 50 and a top cover 60 coating outside the body 20, and a plurality of pressing pins 70 fixed in the body 20 and stretch into the receiving space 21.

Figure 2:
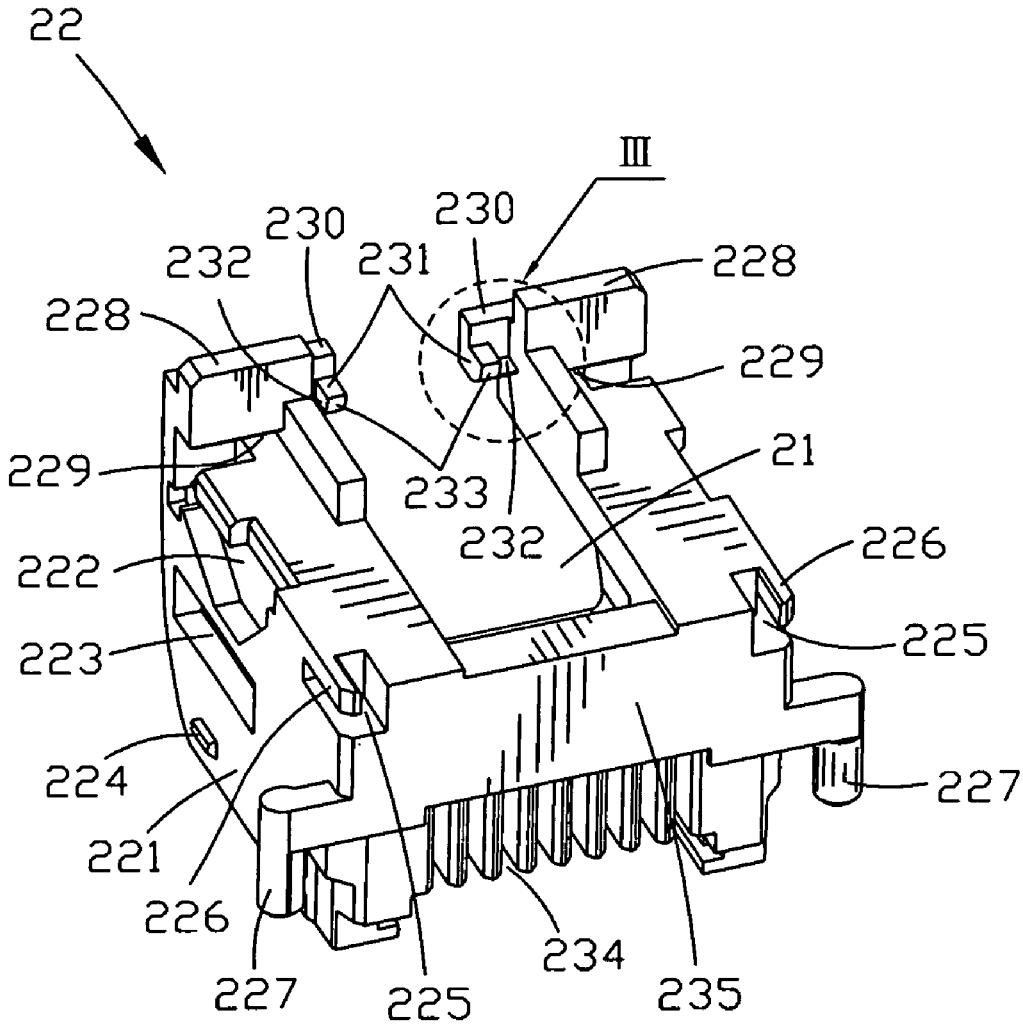
FIG. 2 is a perspective view of a bottom body.
Figure 3:
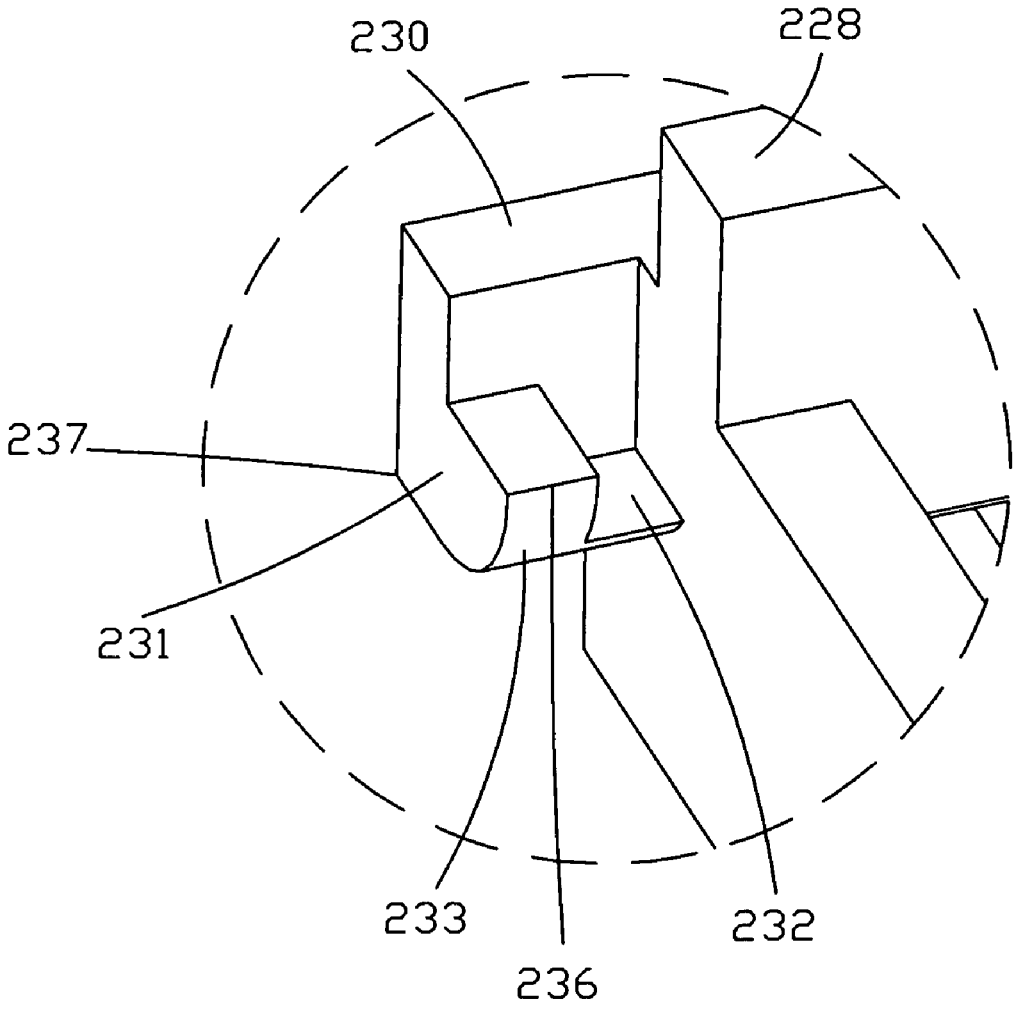
FIG. 3 is an enlarged view of the encircled portion III of FIG. 2.

As shown in FIGS. 1 to 3, the body 20 further includes a bottom body 22 and a top body 24. The bottom body 22 defines a pair of side walls 221. Each side wall 221 defines a trapezoid hole 222 in the top portion and a oblong hole 223 behind the trapezoid hole 222. Both the trapezoid hole 222 and the oblong hole 223 communicate with the receiving space 21. The bottom portion of each side wall 221 defines a pair of fixing lumps 224. The side wall 221 defines a locking lump 226 on the top of the back portion thereof. The rear of the locking lump 226 set apart from the side wall 221 to form a locking channel 225. Bellow the locking lump 226, a fixing pillar 227 is formed for fixing in an external printed circuit board (PCB, not shown). The front portion of the bottom body 22 stretches upward to form a pair of stop boards 228. The back of each stop board 228 forms a fixing channel 229 (as shown in FIG. 2) between the stop board 228 and the top surface of the side wall 221. The front portion of the side walls 221 stretch into the receiving space 21 and form a pair of locking beams 230. As shown in FIG. 3, a guiding projection 231 is defined in the bottom portion of the locking beam 230. The upper surface of the guiding projection 231 is horizontal. The lower surface of the guiding projection 231 is a cambered surface 233. The cambered surface 233 originates from the rear edge 236 of the guiding projection 231 downwardly to the lower side of the locking beam 230. The lower side of the locking beam 230 could be the bottom edge 237 or just a bottom surface of the guiding projection 231. The downward stop point of the cambered surface 231 on the lower side of the locking beam 230 could be limited to any point between the rear edge 236 and the bottom edge 237, depending on the design of the releasing requirement while enduring the accident dragging force. Each guiding projection 231 forms a receiving cavity 232 from the top surface. The receiving cavity 232 stretches backward and communicates with the receiving space 21 of the bottom body 22. The back portion of the bottom body 22 defines a back wall 235. The bottom portion of the back wall 235 defines a plurality of terminal holes 234 for allowing the terminals 35 passing through.

Referring to FIG. 1 again, the top body 24 includes a top wall 241. The top wall 241 forms a pair of hooks 242 on the sides to couple with the locking lumps 226 of the bottom body 22. The mid portion of the top wall 241 stretches downward and forms a stop wall 246 to be received in the receiving space 21. The stop wall 246 presses against the back wall 235 of the bottom body 22. The top wall 241 stretches forward from the front portion to form a pair of fixing arms 243. The front portions of the fixing arms 243 stretch oppositely from the top portion to form a pair of stop arms 244. The front portion of each fixing arm 243 stretches forward from the bottom thereof to form a fixing projection 245 coupling with the fixing channel 229 of the bottom body 22.

The terminal module 30 includes a pedestal 31 and a plurality of terminals 35. The terminal 35 defines a fixing portion 351. The front end of the fixing portion 351 is bent upward to form a contacting portion 352 slanting backwards. The rear of the fixing portion 351 is bent up and stretch backward to form a horizontal soldering portion 353 for being soldered to the external PCB.

The bottom cover 50 defines a pair of first side boards 51. The top portion of each first side board 51 defines a pair of first fixing hole 511. The first side board 51 of the bottom cover 50 defines a pressing piece 512 stretching inward the bottom cover 50 for coupling with the oblong hole 223 of the bottom body 22. Behind the pressing piece 512, the side board 51 defines a fixing piece 513 for fixing to the external PCB. Bellow the pressing piece 512 and the fixing piece 513, a pair of second fixing hole 514 is formed to couple with the fixing lumps 224 of the bottom body 22.

Please continue referring to FIG. 1, the top cover 60 defines a top board 61. The top board 61 is bent downward from the sides to form a pair of second side boards 62. The second side board 62 defines a pair of locking pieces 621 coupling with the first fixing hole 511. The top board 61 is bent downward from the front portion to form a pair of elastic arms 65. Each elastic arm 65 is bent forward from the bottom to form a finger portion 66. The finger portion 66 locates behind the receiving cavity 232 of the bottom body 22 with a gap and can be received in the receiving cavity 232 once the elastic arm 65 is dragged forwardly.

Figure 10:
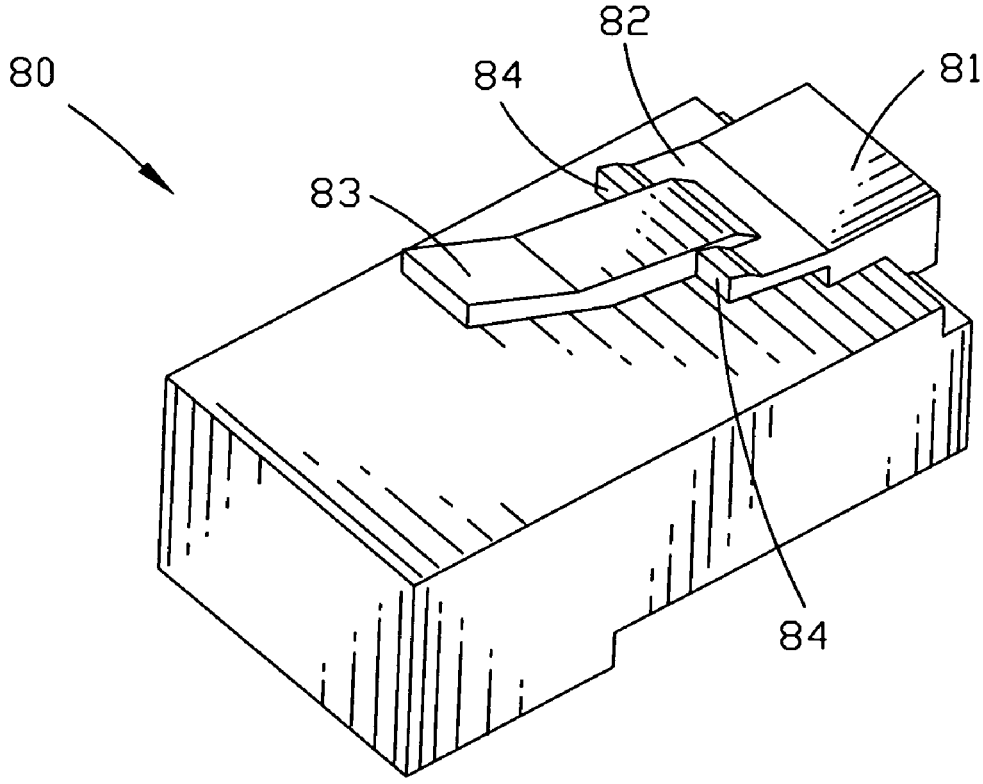
FIG. 10 (Prior Art)
FIG. 10 is a perspective view of a prior known plug connector.

As shown in FIG. 1, the pressing pin 70 defines a horizontal portion 71. The horizontal portion 71 is bent down and stretches backward from the front portion to form a pressing plane 72 for pressing the top surface of the plug connector 80 (shown as FIG. 10).

Figure 4:
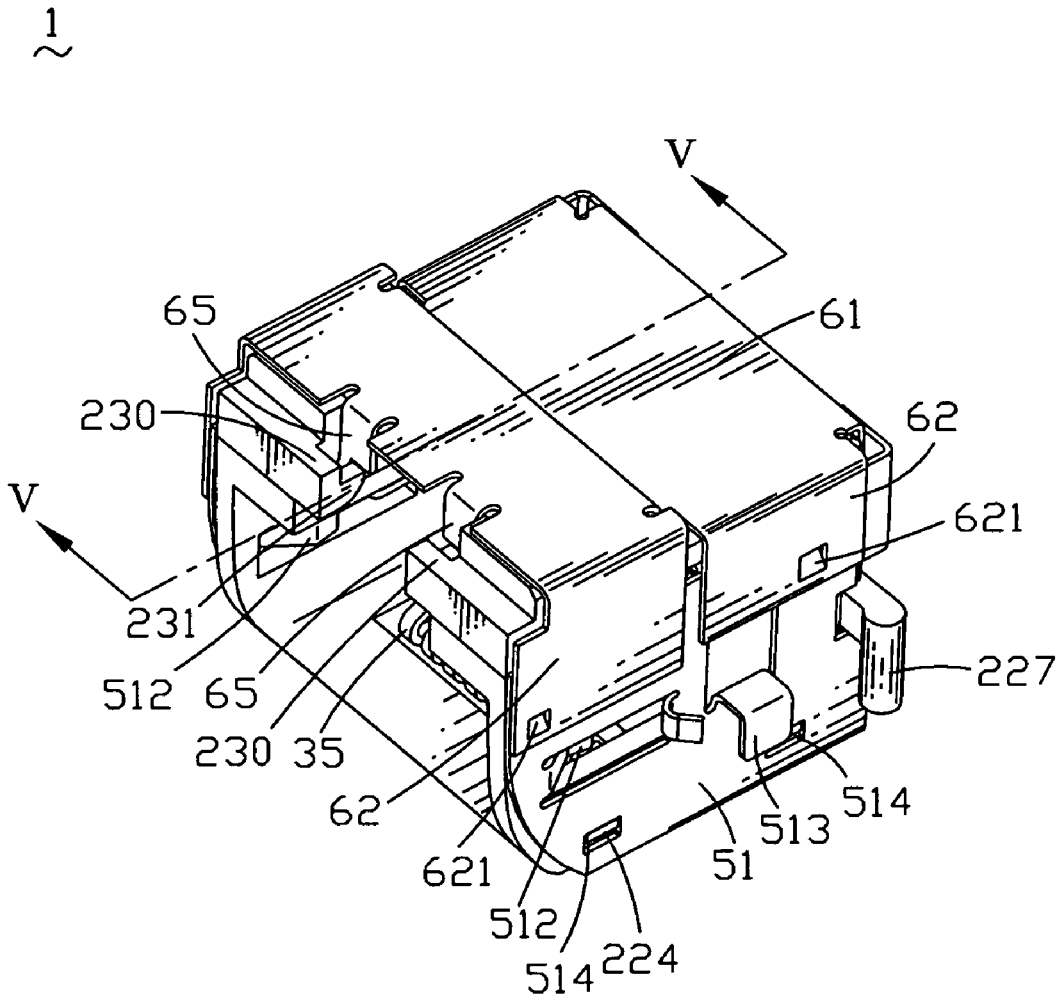
FIG. 4 is a perspective assembled view of the receptacle connector.
Figure 5:
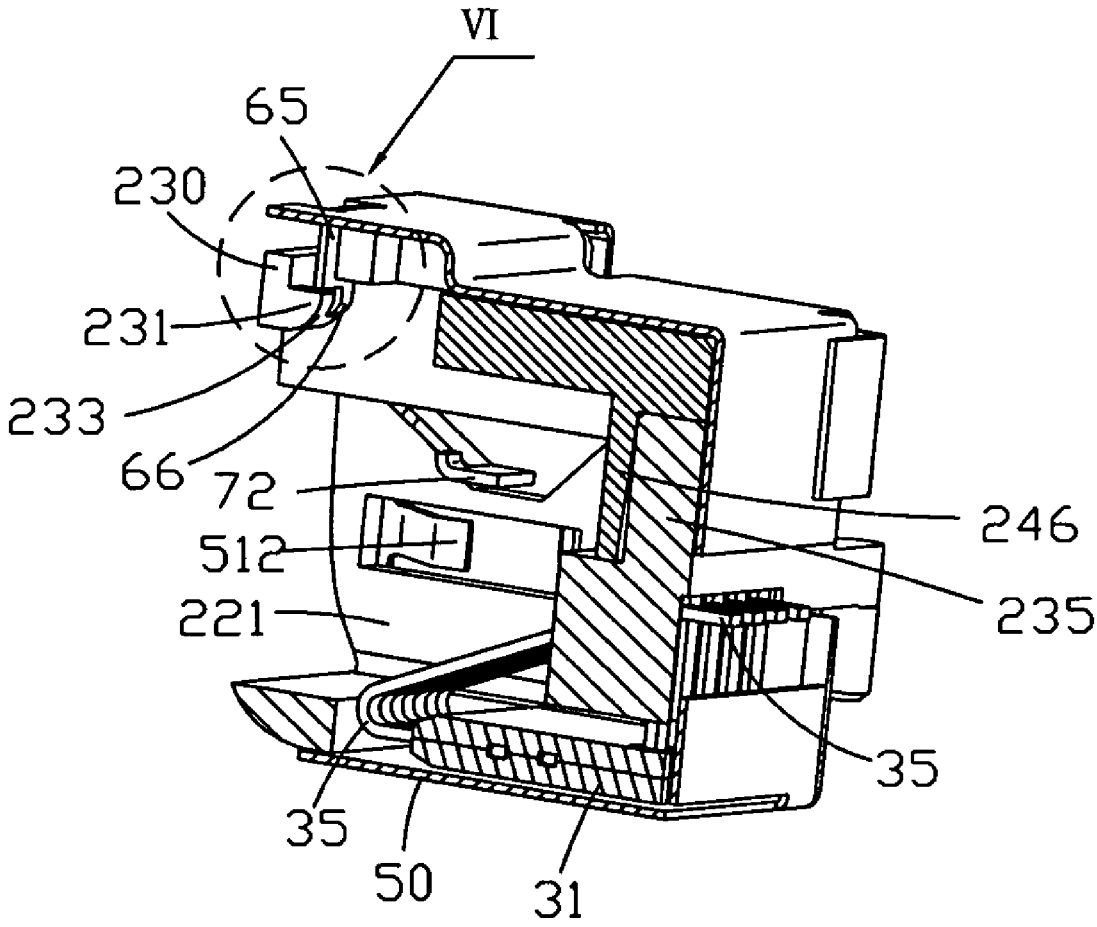
FIG. 5 is a cross-sectional view of the receptacle connector taken along line V—V of FIG. 4.
Figure 6:
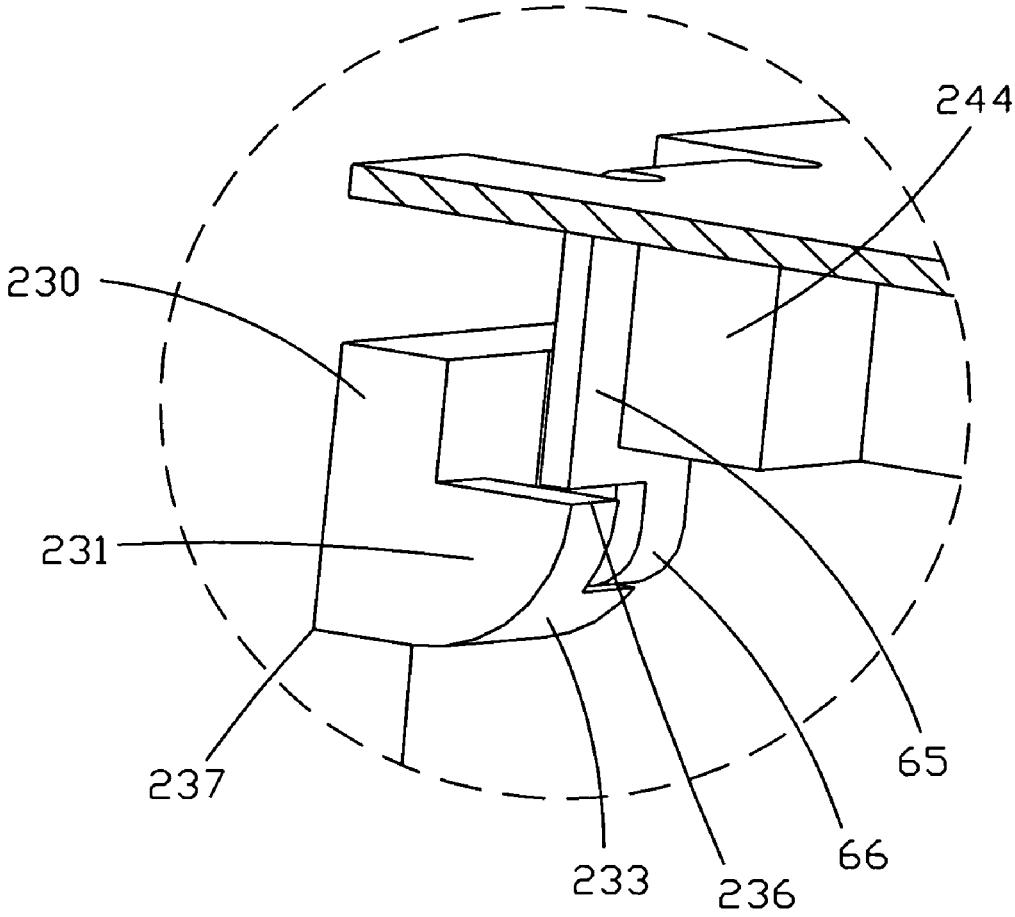
FIG. 6 is an enlarged view of the encircled portion VI of FIG. 5.
Figure 7:
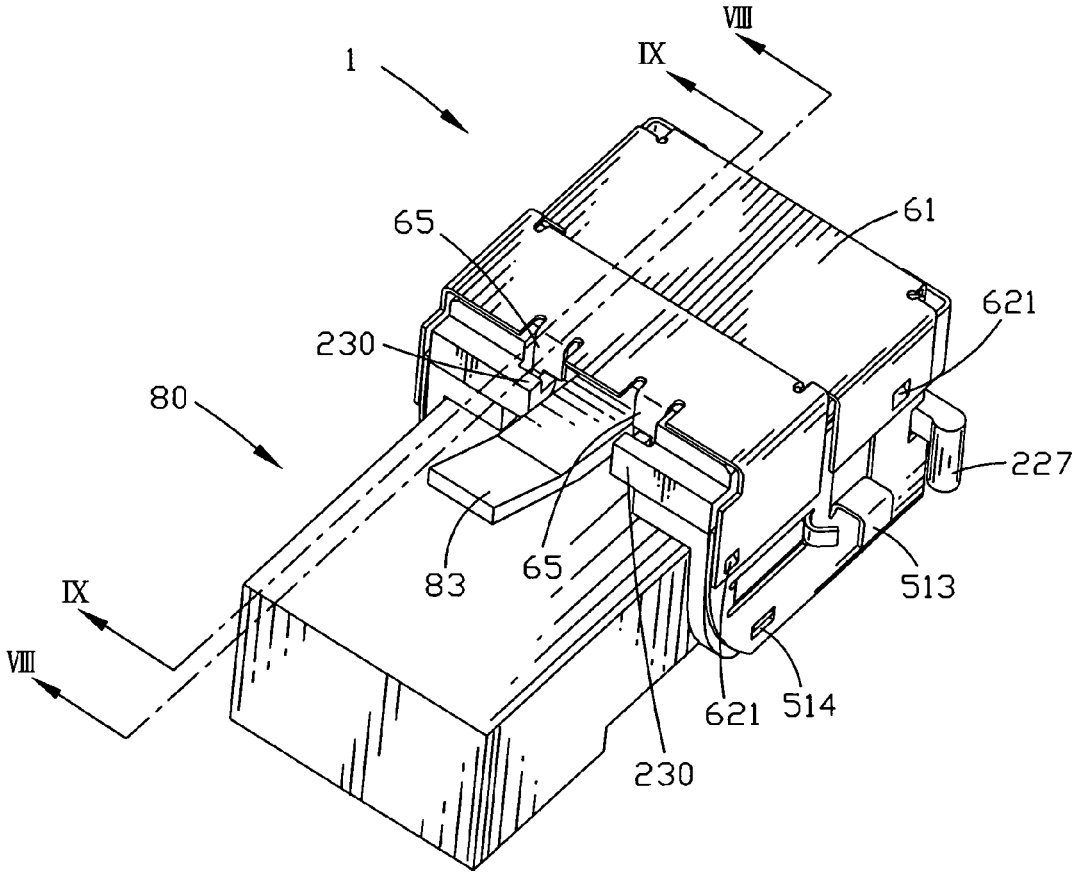
FIG. 7 is a perspective view of a plug connector inserted into the receptacle connector.

Further referring to FIG. 1 and FIG. 4, while the receptacle connector 1 is assembled, the terminals 35 are fixed in the pedestal 31 to form the terminal module 30. The terminal module 30 is fixed in the back portion of the receiving space 21 with the soldering portion 353 stretching out for being soldered to the external PCB. The pressing pins 70 are fixed in the trapezoid hole 222 of the bottom body 22 with the pressing plane 72 stretching into the receiving space 21. Then, the stop wall 246 of the top body 24 is inserted into the receiving space 21 and presses against the back wall 235 of the bottom body 22. The fixing projection 245 of the top body 24 is inserted into the fixing channel 229 of the bottom body 22. The hook 242 of the top body 24 locks the locking lump 226 of the bottom body 22 to achieve the fabrication of the body 20. Then, the bottom cover 22 is fixed outside the bottom body. The pressing pieces 512 of the bottom cover 22 stretch into the receiving space 21 through the oblong hole 223 of the bottom body 22. The second fixing hole 514 of the bottom cover 50 is fixed in the fixing lumps 224 of the bottom body 22. Then, the top cover 60 is fixed. The locking piece 621 of the top cover 60 locks the first fixing hole 511 of the bottom cover 50. As shown in FIG. 5 and FIG. 6, the elastic arm 65 presses the front surface of the stop arms 244 of the top body 24 and locates behind the guiding projection 231 of the bottom body 22.

Referring to FIGS. 5 to 10, while the receptacle connector 1 is in use, the plug connector 80 is inserted into the receiving space 21 of the body 20 with the metal contactors (not shown) contacting the terminals of the receptacle connector 1. The pressing pin 70 presses the top surface of the plug connector 80 (as shown in FIG. 5). The pressing piece 512 of the bottom cover 50 presses the side surface of the plug connector 80. The elastic arms 65 of the top cover 60 press against the locking surfaces 84 of the plug connector 80 to prevent the plug connector 80 sliding out of the receiving space 21 of the receptacle connector 1.

Figure 8:
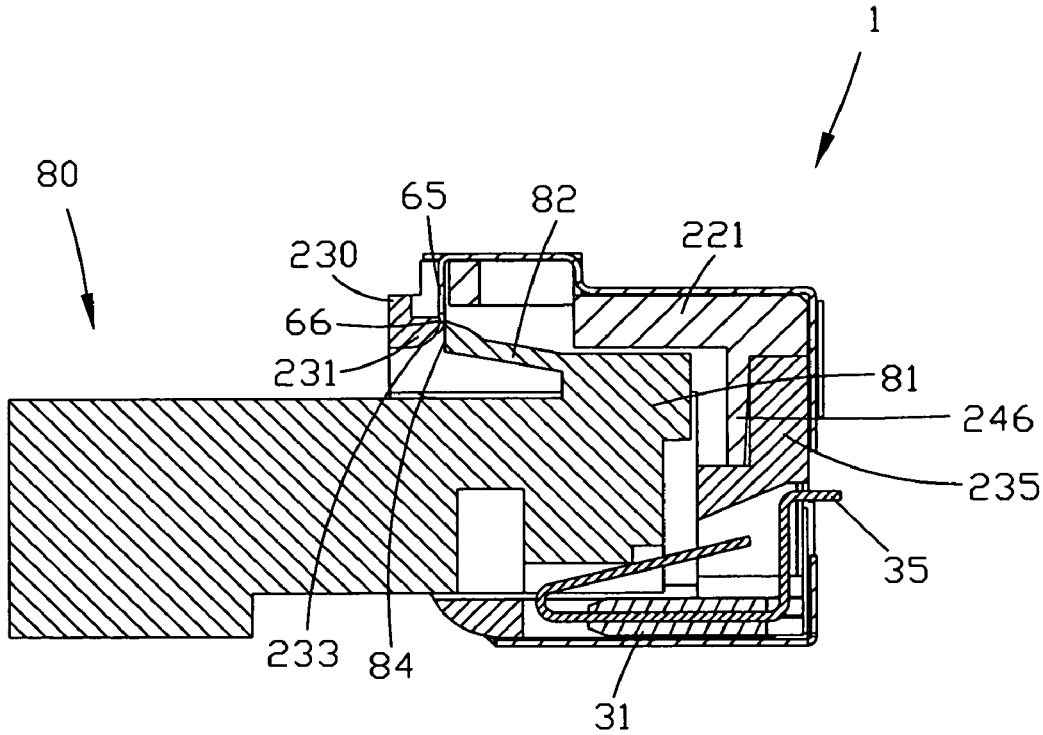
FIG. 8 is a is a cross-sectional view taken along line VIII—VIII of FIG. 7.
Figure 9:
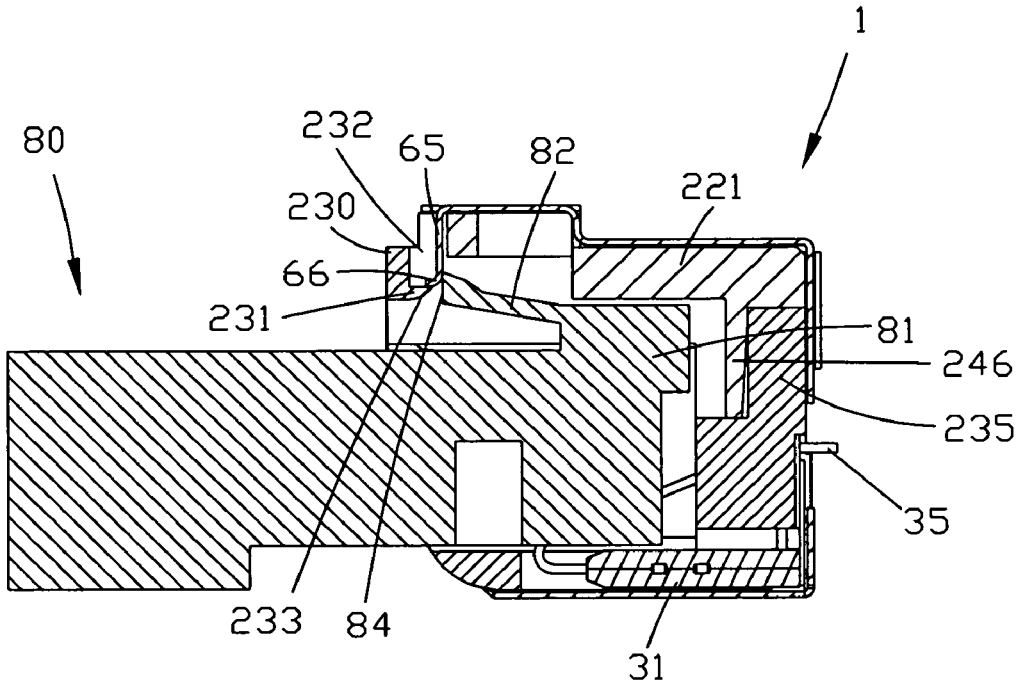
FIG. 9 is a cross-sectional view taken along line IX—IX of FIG. 7.

Referring to FIG. 8 and FIG. 9, when a cable (not shown) connecting with the plug connector 80 is dragged accidentally, the elastic arm 65 is pressed and bent forward. The elastic portion 82 of the plug connector 80 slides downward along the elastic arm 65 and the finger portion 66 received in the receiving cavity 232 to the cambered surface 233 of the guiding projections 231, via the tangent force introduced by the cambered surface 233. Then guided by the cambered surface 233, the elastic portion 82 of the plug connector slides out of the receiving space 21 to further achieve the quick disengagement between the plug connector 80 and the receptacle connector 1. This mechanism avoids the sudden movement of the devices using such receptacle connector 1 or the damage of the receptacle connector 1.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A receptacle connector comprising:

an insulated body having a pair of side walls, front portions of said side walls extend oppositely to form a pair of locking beams;

a plurality of terminals received in said body;

a conductive cover having a top cover and a bottom cover for covering said body; and a releasing mechanism for releasing a plug connector from said receptacle connector, the releasing mechanism having a guiding projection extending rearwardly from said body, and defining a cambered surface, a receiving cavity defined beside said guiding projection, an elastic arm extending downwardly from said top cover, and a finger portion bent forwardly from a bottom portion of said elastic arm, wherein when said plug connector is pulled out, said finger portion is pressed forwardly and received in said receiving cavity and in combination with said cambered surface of said guiding projection to make a locking portion of said plug connector be forced downwardly by said cambered surface, so that said plug connector is removed from said receptacle connector.

2. The receptacle connector as claimed in claim 1, wherein said guiding projection is defined by a bottom portion of said locking beams.

3. The receptacle connector as claimed in claim 2, wherein said cambered surface of said guiding projection originates from a rear edge of said guiding projection downwardly to a lower side of said locking beam.

4. The receptacle connector as claimed in claim 3, wherein said lower side of said locking beam is a bottom edge of said guiding projection.

5. The receptacle connector as claimed in claim 3, wherein said cambered surface on said lower side of said locking beam is limited between said rear edge and said bottom surface of said locking beam.

6. The receptacle connector as claimed in claim 2, further comprising at least one trapezoid hole defined in said side wall, and at least one pressing pin, fixed in said trapezoid hole, defining a pressing plane extending into a receiving space of said body and pressing a top surface of said plug connector.

7. The receptacle connector as claimed in claim 2, further comprising at least one oblong hole defined in said side wall, and at least one pressing piece, defined in said bottom cover and extending into said receiving space through said oblong hole and pressing said plug connector.

8. The receptacle connector as claimed in claim 1, further comprising a support member fixed in said body, and said terminals received in said support member.

9. The receptacle connector as claimed in claim 1, further comprising a pair of side walls, defined in said body, defining at least one trapezoid hole, and at least one pressing pin, fixed in side trapezoid hole, defining a pressing plane extending into said receiving space of said body and pressing a top surface of said plug connector.

10. The receptacle connector as claimed in claim 1, further comprising at least one oblong hole defined in said side wall, and at least one pressing piece, defined in said bottom cover, extending into said receiving space through said oblong hole and pressing said plug connector.

11. The receptacle connector as claimed in claim 1, wherein said body further comprises a top body and a bottom body; and said receiving space is formed in said bottom body.

12. The receptacle connector as claimed in claim 11, further comprising a back wall defined in said bottom body, and a stop wall extending downward from a mid portion of said top body, wherein said stop wall is received in said receiving space and presses backwardly against said back wall.

13. The receptacle connector as claimed in claim 11, further comprising a pair of stop boards extending upwardly from a front portion of said bottom body, at least one fixing channel defined in a back of said stop board, at least one fixing arm, defined in front portion of said top body, pressing said stop boards forwardly, a fixing projection extending forwardly from a bottom of said fixing arm, and fixed in said fixing channel.

14. The receptacle connector as claimed in claim 11, further comprising a locking lump defined on top of said side wall with a rear of said locking lump setting apart from said side wall to form a locking channel, and a pair of hooks defined in side of said top body, wherein said hooks are received in said locking channel and locks said locking lump.

* * * * *